US007742007B2

(12) United States Patent
Rhodes et al.

(10) Patent No.: US 7,742,007 B2
(45) Date of Patent: Jun. 22, 2010

(54) TRANSMISSION OF UNDERWATER ELECTROMAGNETIC RADIATION THROUGH THE SEABED

(75) Inventors: Mark Rhodes, West Lothian (GB); Brendan Hyland, Edinburg (GB); Derek Wolfe, West Lothian (GB)

(73) Assignee: Wireless Fibre Systems, Livingston (GB)

( * ) Notice: Subject to any disclaimer, the term of this patent is extended or adjusted under 35 U.S.C. 154(b) by 689 days.

(21) Appl. No.: 11/339,336

(22) Filed: Jan. 24, 2006

(65) Prior Publication Data

US 2007/0146219 A1 Jun. 28, 2007

(30) Foreign Application Priority Data

Dec. 23, 2005 (GB) ..... 0526303.3

(51) Int. Cl.
*H01Q 1/04* (2006.01)

(52) U.S. Cl. ..... 343/719; 343/709; 343/787

(58) Field of Classification Search ..... 343/709, 343/719, 787, 788, 895; 455/40; 324/334, 324/337

See application file for complete search history.

(56) References Cited

U.S. PATENT DOCUMENTS

| | | | | |
|---|---|---|---|---|
| 4,458,248 | A * | 7/1984 | Lyasko | 343/719 |
| 6,154,179 | A * | 11/2000 | Kohno | 343/719 |
| 6,859,038 | B2 * | 2/2005 | Ellingsrud et al. | 324/334 |
| 7,126,338 | B2 * | 10/2006 | MacGregor et al. | 324/334 |
| 7,203,599 | B1 * | 4/2007 | Strack et al. | 702/2 |
| 7,453,763 | B2 * | 11/2008 | Johnstad | 367/20 |
| 2007/0135044 | A1 * | 6/2007 | Rhodes et al. | 455/40 |

* cited by examiner

*Primary Examiner*—Tan Ho
(74) *Attorney, Agent, or Firm*—Paul Davis; Goodwin Procter LLP

(57) ABSTRACT

An underwater communication method is provided. EM signals are transmitted via a seabed using an underwater electrically insulated magnetically coupled antenna. By making use of the low loss properties of the seabed, EM signal attenuation can be reduced and consequently the transmission range can be increased. The underwater electrically insulated magnetically coupled antenna may be located within a body of water or may be buried in the seabed.

11 Claims, 7 Drawing Sheets

TRANSMISSION OF UNDERWATER ELECTROMAGNETIC RADIATION THROUGH THE SEABED

CROSS REFERENCE TO RELATED APPLICATIONS

This application claims the benefit of United Kingdom application serial no. GB 0526303.3 filed Dec. 23, 2005, which application is fully incorporated herein by reference.

The present invention relates to an underwater communications system that uses an electromagnetic propagation path through the seabed, lake bed or bed of any other body of water. This provides system performance advantages compared to a direct path through water.

BACKGROUND OF THE INVENTION

WO01/95529 describes an underwater communications system that uses electromagnetic signal transmission. This system has a transmitter and a receiver, each having a metallic aerial that is surrounded by a waterproof electrically insulating material. Underwater communications systems are also described in GB0511939.1 and U.S. 60/690,966. These use magnetically coupled antennas for the transmission and reception of electromagnetic signals. Whilst employing electromagnetic (EM) radiation for underwater communications offers significant advantages over traditional acoustic techniques such as immunity to acoustic noise and higher bandwidth, the attenuation of EM radiation through water is significant.

SUMMARY OF THE INVENTION

According to the present invention, there is provided an underwater communication method comprising transmitting EM signals via a seabed using an underwater electrically insulated magnetically coupled antenna.

By making use of the low loss properties of the seabed, EM signal attenuation can be reduced and consequently the transmission range can be increased. It should be noted that in the context of this application "seabed" means the bed of any body of water, such as a loch, lake, or ocean.

The underwater electrically insulated magnetically coupled antenna may be located within the body of water or may be buried in the seabed.

The method may further involve receiving the EM signals at an underwater, electrically insulated magnetically coupled antenna. The underwater receiver antenna may be located within the water or buried in the seabed.

The EM signal could be any information carrying communication signal for use in, for example, a an underwater communication system for allowing communication between two divers, a navigation system and a remote sensing system for identifying objects or any other system that requires the exchange of EM signals.

According to another aspect of the present invention, there is provided an underwater communication system comprising a transmitter having an underwater electrically insulated magnetically coupled antenna that is operable to transmit EM signals through the seabed.

The system may be bidirectional, employing a transmitter and receiver at both ends of the communications system. The transmitting and receiving stations may have an antenna at each such that the radiation is preferentially directed into the seabed. The seabed then acts as a lower loss transmission path for the radiation compared to the direct path through water.

At least one of the antennas may be buried in the seabed to maximise coupling to the lower loss medium. One of the antennas may be based on land. The land-based station optimally comprises a buried, magnetic coupled antenna.

DETAILED DESCRIPTION OF DRAWINGS

Figure 1:
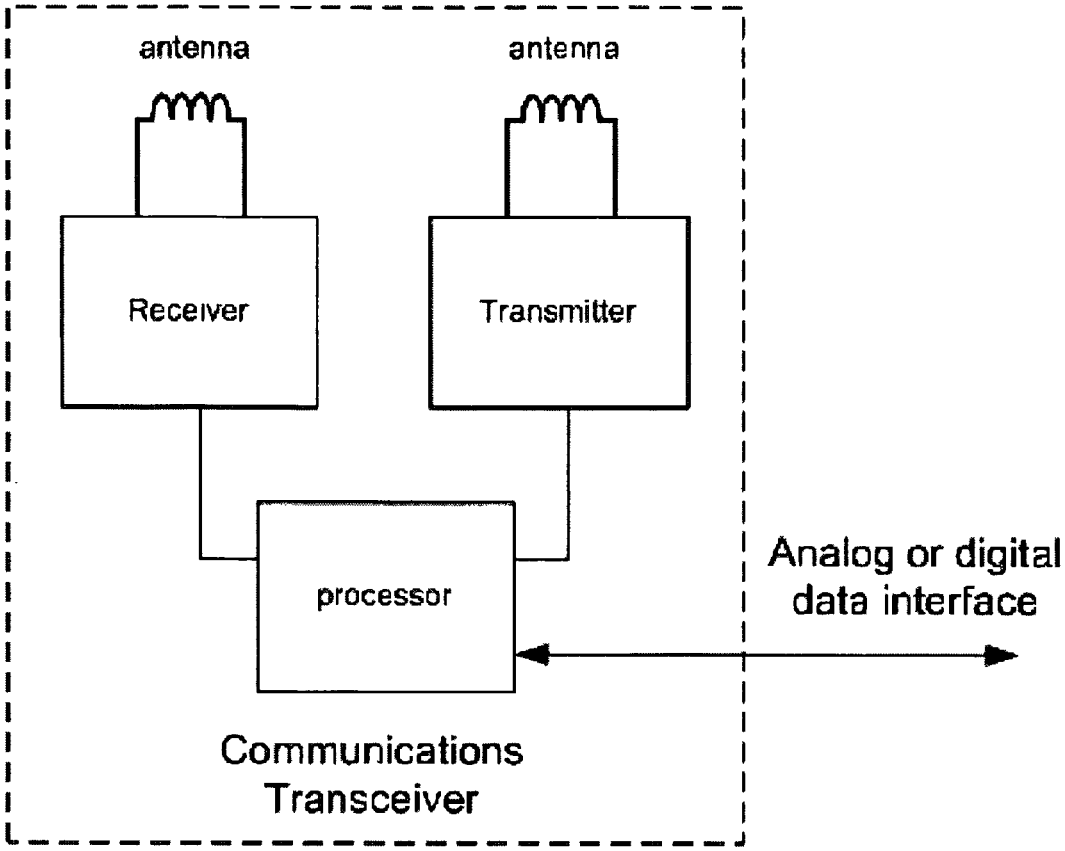
FIG. 1 is a block diagram of an underwater transceiver.

FIG. 1 shows an antenna configuration that is optimised for the transmission and reception of electromagnetic signals underwater. This has a transmitter and a receiver coupled to a waterproof, electrically insulated, magnetic coupled antenna. This type of antenna is needed because water is an electrically conducting medium, and so has a significant impact on the propagation of electromagnetic signals. Any suitable transmitter/receiver arrangements could be used.

Figure 2:
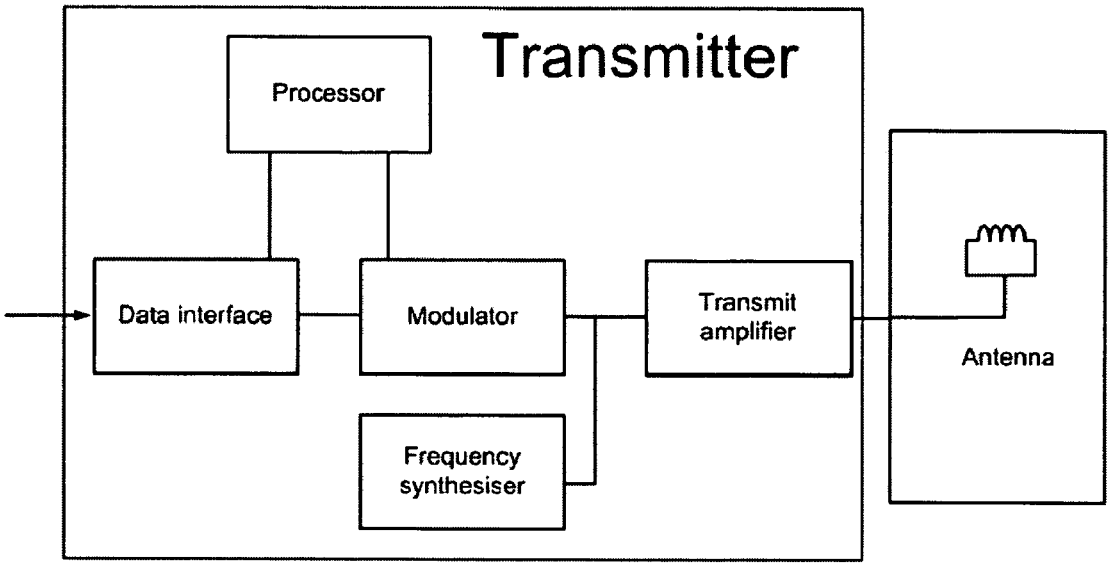
FIG. 2 is a block diagram of a transmitter for use in the transceiver of FIG. 1.

FIG. 2 shows an example of a suitable transmitter in more detail. This has a data interface that is connected to each of a processor and a modulator. The modulator is provided to encode data/information from the interface onto a carrier wave. At an output of the modulator are a frequency synthesiser that provides a local oscillator signal for up-conversion of the modulated carrier and a transmit amplifier, which is connected to the antenna. In use, the transmitter processor is operable to cause information carrying electromagnetic communication signals to be transmitted via the antenna at a selected carrier frequency.

Figure 3:
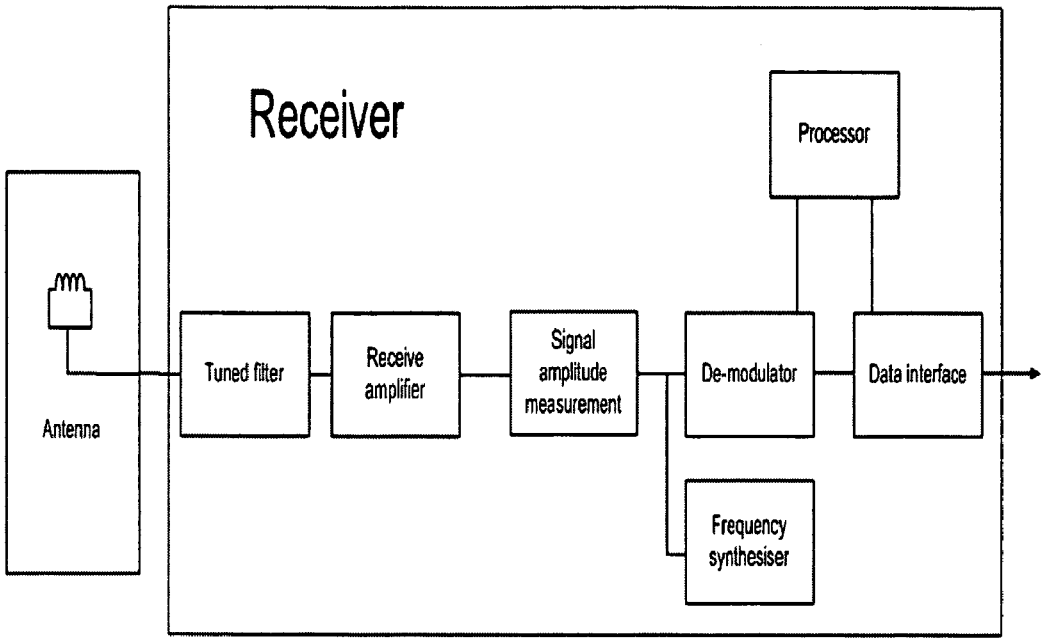
FIG. 3 is a block diagram of a receiver for use in the transceiver of FIG. 1.

FIG. 3 shows an example of a receiver for use in the transceiver of FIG. 1. As with the transmitter, this has an electrically insulated magnetic antenna adapted for underwater usage. As shown in FIG. 1, this is shared with the transmitter antenna. However, it will be appreciated that this could be provided separately. The receiver antenna is operable to receive magnetic field signals from a transmitter. Connected to the antenna is a tuned filter that is in turn connected to a receive amplifier. At the output of the amplifier are a signal amplitude measurement module that is coupled to a de-modulator and a frequency synthesiser, which provides a local oscillator signal for down conversion of the modulated carrier. Connected to the de-modulator are a processor and a data interface, which is also connected to the processor. The data interface is provided for transferring data/information received and decoded by the receiver to a control or monitoring means, such as another on-board processor, which may be located in the mobile device or at another remote location.

Figure 4:
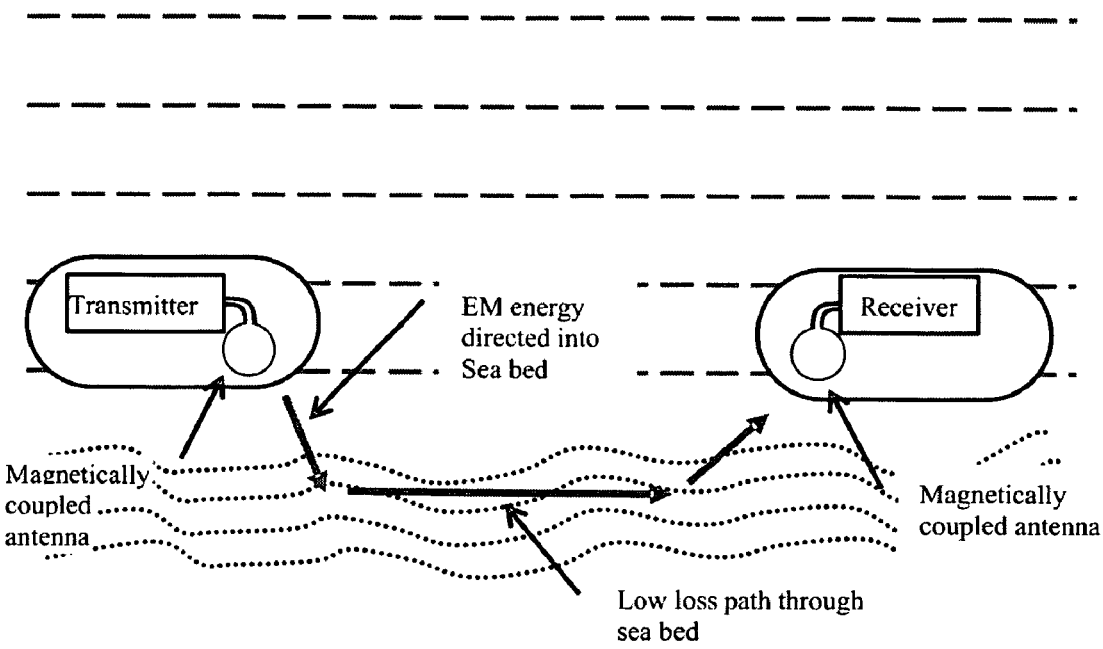
FIG. 4 illustrates two communicating stations placing antennas in close proximity to the seabed.

FIG. 4 shows first and second mobile stations, each of which includes a transceiver of the type shown in FIG. 1. The electrically insulated, magnetic coupled antenna of both mobile stations is positioned so that the EM signals can be injected into the seabed and subsequently detected when they re-emerge. In use, the mobile stations have to be close enough to the seabed to allow signal injection to occur. To optimise the benefits of the lower seabed conductivity, the transmitter and receivers should be moved or held in position as close to the seabed as is practical.

Signals transmitted from the first mobile station enter the seabed, traverse it and emerge to be detected by the second station. Hence, the EM signal transmission path has a first, relatively short part that is through water, a second longer path that is via the seabed and a final part that is again through water. EM loss through the seabed varies depending on local geological composition, but is universally much lower than seawater. Seabed conductivity ranges from around 0.01 S/m to 1.0 S/m while seawater is typically 4 S/m (2 S/m to 6 S/m at its global extremes). This lower conductivity is primarily because of the non-conductive nature of sand, stone and other particles that typically form the bed of bodies of water. By minimising the through water portions of the transmission path, attenuation can be reduced.

As an example, consider the situation where the seawater has a conductivity of 4 S/m and the seabed has a conductivity of 1 S/m. For through water transmission only, the communication range would be 25 m. However, in accordance with the invention, if both antennas were situated one meter above the seabed, aligned for optimal coupling into the seabed, the transmission range would be around 40 m. This is a significant improvement.

As will be appreciated, for the arrangement of FIG. 4, as the height of the antennas above the seabed increases the direct signal path through water dominates and the benefit of the seabed path component diminishes. In practice, the length of the through water path will vary. However, whatever the conditions, geometrically there is no benefit once the antenna height is equal to half the antenna separation since the water path length is equal for both routes. Hence, in use the mobile stations should be positioned so that the antenna height is less than half the antenna separation.

Figure 5:
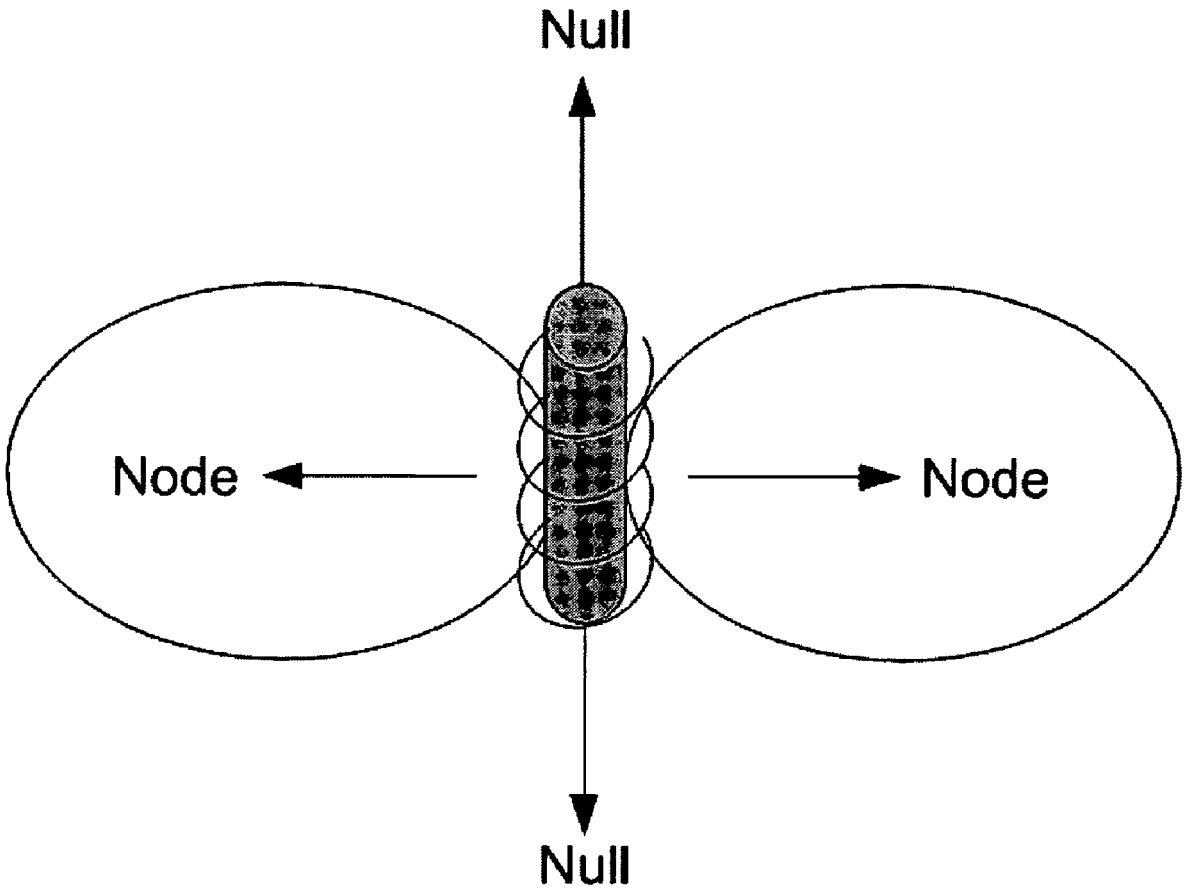
FIG. 5 illustrates a magnetic field pattern from a solenoid antenna.
Figure 6:
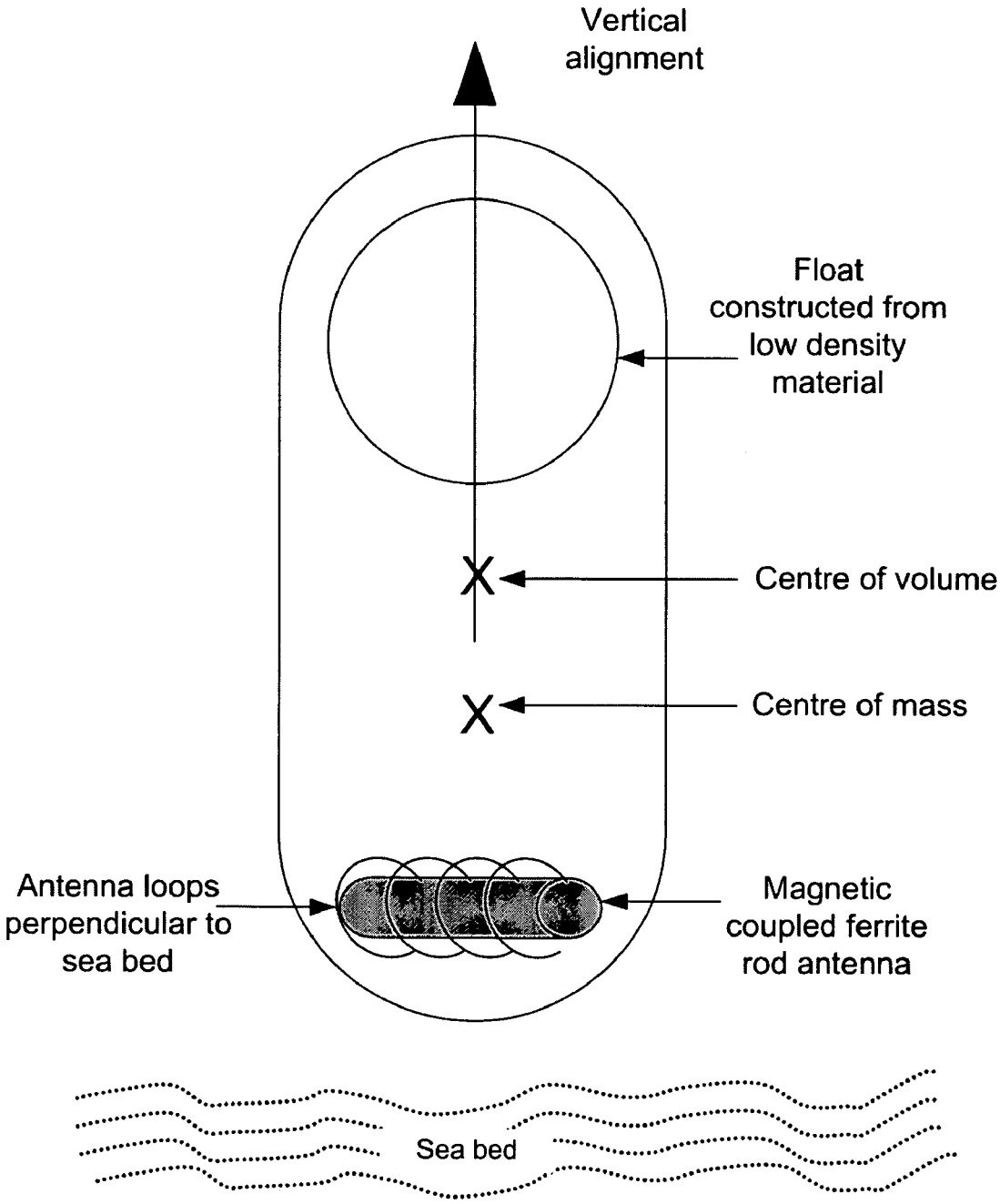
FIG. 6 illustrates a float design to ensure optimal vertical alignment of a magnetic coupled loop antenna.

To optimise the performance of the arrangement of FIG. 4, the magnetically coupled antenna should be positioned to maximise the signal that is injected into the seabed. Where the antenna is a magnetic solenoid antenna, the signal is at a maximum in a direction perpendicular to the solenoid, as shown in FIG. 5. By holding the solenoid substantially horizontally, signal injection can be optimised. FIG. 6 illustrates an arrangement for ensuring the solenoid is held in a fixed orientation relative to the vertical. This has a float that is constructed of a low-density material, for example polyester foam. The float will be placed to move the antenna housing's centre of mass away from its centre of volume such that the antenna is held in a stable orientation parallel to the seabed. For a typical horizontal seabed this will optimise signal coupling into the seabed material.

Figure 7:
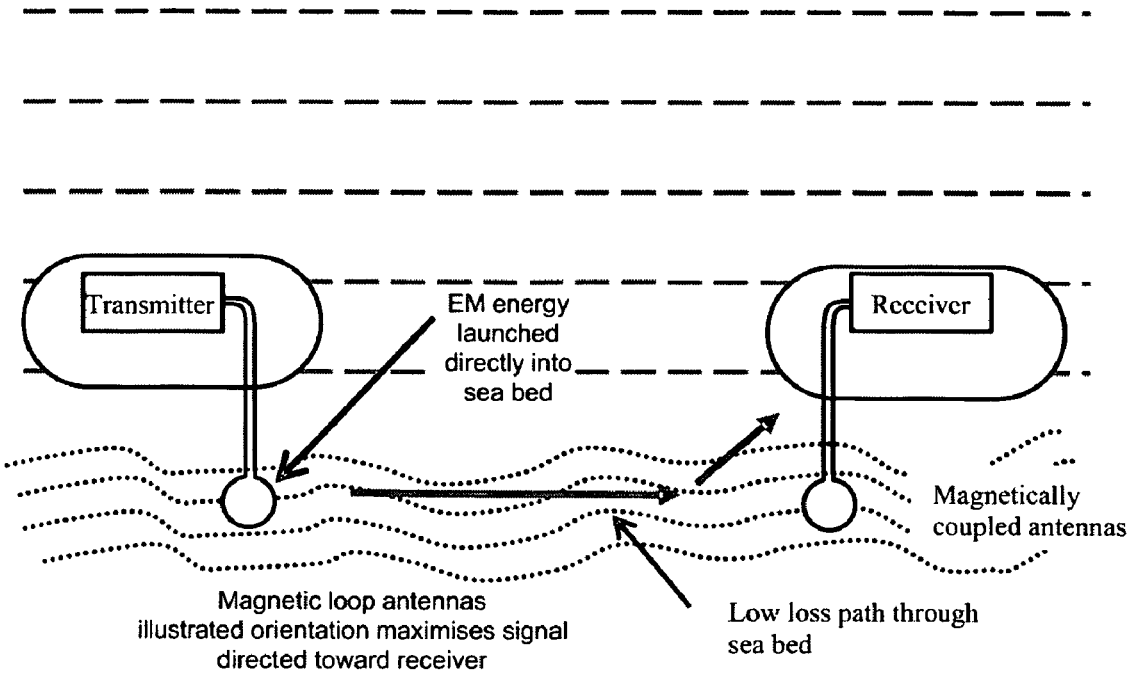
FIG. 7 illustrates two communicating stations implementing buried antennas to optimise the transmission path.

FIG. 7. shows another arrangement that reduces through water attenuation. As before, this has two communication stations, each having a transceiver having substantially the same form as that of FIG. 1. However, in this case, the electrically insulated, magnetic coupled antennas of both stations are provided at the end of extended connections and are buried in the seabed. Hence, in this case, the EM signal transmission path is solely through the seabed, with no through water part. It should be noted that in this case, the communication stations may be in a substantially fixed position or may be able to move. This depends on the nature of the connection between the stations and their buried antennas. In this case, for seawater with a conductivity of 4 S/m and a seabed with a conductivity of 1 S/m, a radio system that could operate over a 120 dB link loss budget would have a 50 m range for the seabed path, whereas the through water range would be 25 m. Hence, for the embedded antenna arrangement of FIG. 7, the effective signal range is doubled.

The system and method in which the invention is embodied provide numerous advantages, not least a significantly improved range. However, in addition to range benefits the seabed path also offers reduced signal distortion for a given range. This is because the lower conductivity compared to water reduces phase dispersion. A further advantage is that the seabed potentially provides a covert path for communications, thereby minimising the ability of other parties to intercept or detect communications compared to the more conventional lower loss approach of using through air transmission at the air-water interface using surface penetration of the antenna.

A skilled person will appreciate that variations of the disclosed arrangements are possible without departing from the invention. For example, although the specific implementations of FIGS. 4 and 7 are described separately, it will be appreciated that these could be combined, e.g. one of the mobile stations could have the antenna arrangement of FIG. 4 and the other could have an embedded antenna arrangement of FIG. 7. Alternative configurations are clearly available, for example, the communication stations may be fixed in position, not mobile, and one of the communication stations could be on land. In this case, preferably the land station has a magnetic coupled antenna that is buried underground. Accordingly the above description of the specific embodiment is made by way of example only and not for the purposes of limitation. It will be clear to the skilled person that minor modifications may be made without significant changes to the operation described.

The invention claimed is:

1. An underwater communication method comprising generating and transmitting EM signals between a transmitter and a receiver via a direct signal transmission path through seabed using an underwater electrically insulated magnetically coupled antenna positioned within the seawater close to the seabed, wherein the antenna is also positioned to maximize the signals directed toward the receiver through the seabed.

2. A method as claimed in claim 1 further involve receiving EM signals at an underwater electrically insulated magnetically coupled antenna.

3. A method as claimed in claim 2 wherein the underwater receiver antenna is located within the water or buried in the seabed.

4. A method as claimed in claim 1 wherein the EM signal is any information carrying communication signal for use in at least one of an underwater communication system for allowing communication between two divers, a navigation system and a remote sensing system for identifying objects or any other system that requires the exchange of EM signals.

5. A method as claimed in claim 1 comprising aligning and/or positioning the antenna to optimise signal coupling through the path.

6. An underwater communication system comprising a transmitter having an underwater electrically insulated magnetically coupled antenna that is operable to transmit EM signals to a receiver through a direct signal transmission path through seabed, wherein the antenna is positioned to maximize the signals directed toward the receiver through the seabed.

7. A system as claimed in claim 6 including the receiver having an underwater electrically insulated magnetically coupled antenna.

8. A system as claimed in claim 7 wherein the transmitter and receiver share one antenna.

9. A system as claimed in claim 6 wherein the transmitter antenna is arranged so that radiation is preferentially directed into the seabed.

10. A system as claimed in claim 6 wherein the antenna is buried in the seabed.

11. A system as claimed in claim 6 wherein the antenna is based underground.

* * * * *